United States Patent [19]

Adler

[11] Patent Number: 4,479,655

[45] Date of Patent: Oct. 30, 1984

[54] BOOMERANG

[76] Inventor: Alan J. Adler, 752 La Para Ave., Palo Alto, Calif. 94306

[21] Appl. No.: 564,471

[22] Filed: Dec. 21, 1983

[51] Int. Cl.[3] ..... A63B 65/08

[52] U.S. Cl. ..... 273/425; 273/426

[58] Field of Search ..... 273/425, 426

[56] References Cited

U.S. PATENT DOCUMENTS 4,222,573 9/1980 Adler ..... 273/426

4,421,320 12/1983 Robson ..... 273/425

*Primary Examiner*—Paul E. Shapiro

*Attorney, Agent, or Firm*—Limbach, Limbach & Sutton

[57] ABSTRACT

A boomerang of circular configuration. A planar ring having a streamlined cross-section described by a convex upper surface and a straight lower surface defines a central opening and an outer perimeter. Three wings extend radially from the outer perimeter and have a similar cross-section. The wings are twisted relative to the plane of the ring to produce aerodynamic lift. The planiform area of the central opening is about 115 percent of the total planiform area of the wings. The ring and body are constructed with an inner plastic armature, surrounded by a cushion of elastomeric materials softer than the armature.

7 Claims, 5 Drawing Figures

BOOMERANG

The present invention relates to amusement and sporting devices and more specifically to boomerangs.

BACKGROUND OF THE INVENTION

The flight of the boomerang has fascinated man for thousands of years. In this century it has attracted the attention of many scientific minds. Basically the flight is a circular path, similar to that of an airplane executing a banked turn.

The boomerang is thrown overhand with its plane in nearly vertical orientation accompanied by a snapping action to impart rotation. It flies in a circle because the upper wings, which are rotating into the wind, develop greater aerodynamic lift (due to their greater relative airspeed) than the lower wings which are rotating with the wind. This creates a banking moment which is converted by gyroscopic precession to a turn. There is a saying that the boomerang is the device "that can't be thrown away"—because it can't fly in a straight line.

It is well known that the earliest boomerangs were constructed of wood. Their planform was curved to form an arc or "L" shape which is often referred to as the Australian or aboriginal shape. Boomerangs of this shape have existed for several millenia.

A number of designs suitable for construction in thermoplastic have been patented. These designs often had three or more wings as opposed to the two wings of the aboriginal configuration. The benefit of more wings was that each of the wings could be shorter than those of the aboriginal design. These shorter wings were much better suited to the greater flexibility of thermoplastic materials—when compared to wood. Examples of such boomerang patents are:

U.S. Pat. No. 3,082,572 to Knox
U.S. Pat. No. 3,403,910 to Claycomb
U.S. Pat. No. 3,955,817 to Davis Claycomb uses three wings while Knox and Davis each employ a greater number of wings, surrounded by an outer hoop.

Other devices of relevance are:

U.S. Pat. No. 862,094 to Morton
U.S. Pat. No. 2,234,022 to Prause
US Magazine, June 20,1983, photograph on page 38.

Morton, in his FIG. 5, discloses a device with four wings joined together at a small ring-shaped hub. Prause discloses a three winged boomerang wherein the wings join together in the center in a manner which produces a small triangular central openings. US Magazine shows a six-winged boomerang which resembles the Morton device, except for its greater number of wings.

These boomerangs fly in a relatively small diameter flight pattern when compared to their aboriginal ancestors. Because of this small flight pattern, their performance has always been of limited interest to an experienced boomeranger who seeks the challenge and excitement of a long range flight pattern.

The experienced boomeranger also takes pride in catching a boomerang with one hand when it returns. Though somewhat dangerous there are formal boomerang competitions which include one-handed catching. While this is possible with the aboriginal shape which is caught (very carefully) in its center, it is impractical with multi-winged designs such as those listed above.

Two other aerial devices, both of "Flying Saucer" classification are noted here:

U.S. Pat. No. 4,203,249 to Bohm
U.S. Pat. No. 4,307,535 to Martin

Although these devices are classified as "flying saucers" rather than boomerangs, their inventors make reference to "boomerang" behavior. Thus they are included here.

It has been found that devices like those disclosed by Bohm and Martin can be made to return by throwing them upwards at an angle of about 45 degrees and into a strong wind so that it may slide back down to the thrower, but they are not capable of executing the flight of a boomerang—which is a full circle of flight at a relatively constant altitude. The Bohm and Martin discs are not be capable of executing the required maneuvers in a boomerang tournament and thus are not commercialy valuable in that market.

OBJECT OF THE INVENTION

The object of the present invention is to provide a boomerang which;

a. has a long-range flight pattern like a classic Australian or tournament-quality boomerang,
b. can be caught easily and safely with one hand upon return,
c. can be mass produced from thermoplastic materials.

THE DRAWINGS

DETAILED DESCRIPTION OF THE PREFERRED EMBODIMENT OF THE INVENTION

Figure 1:
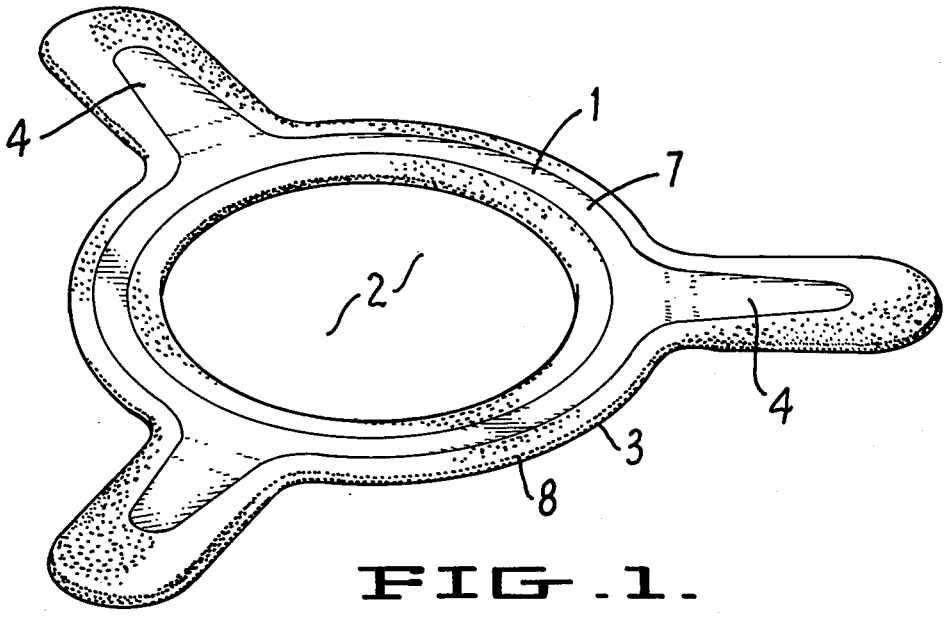
FIG. 1 is a perspective of the invention viewed from above.
Figure 2:
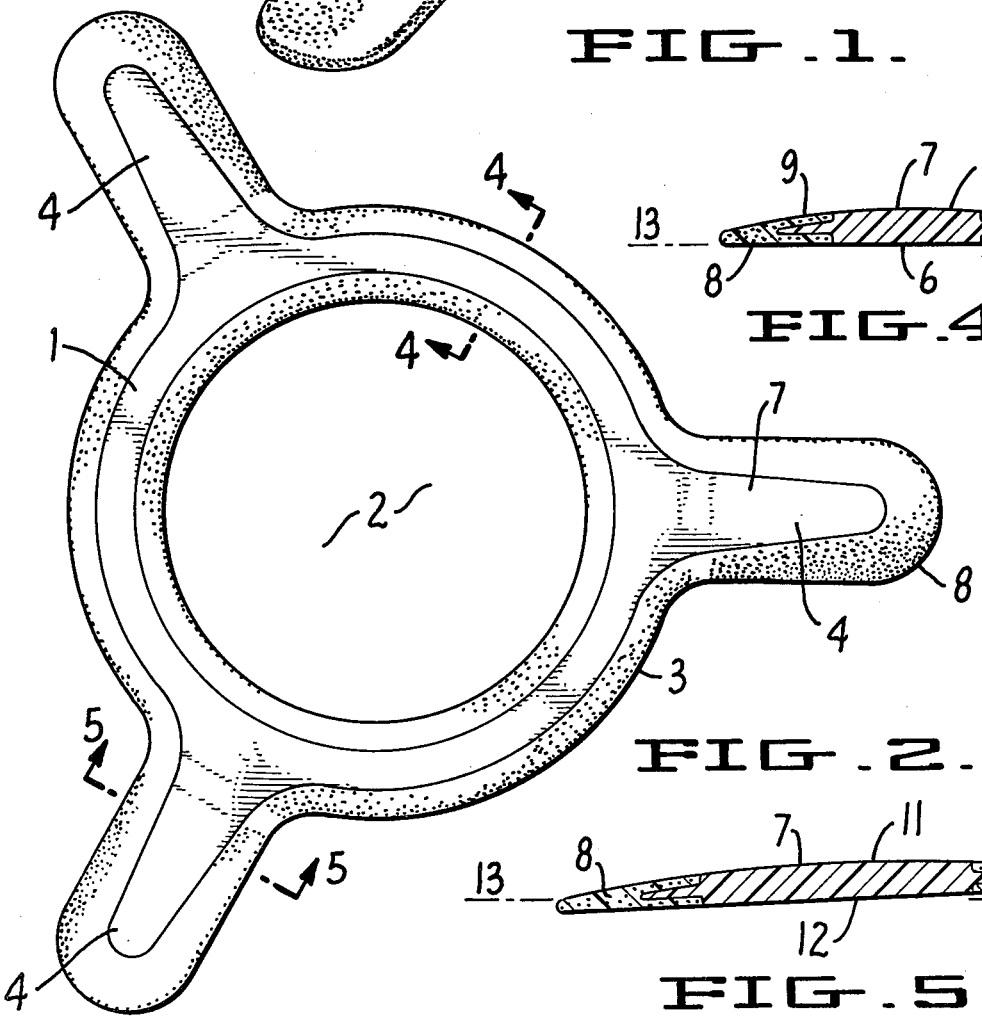
FIG. 2 is a plan view of the invention

Referring to FIG. 1 note that the preferred embodiment of the invention is a boomerang of substantially planar configuration comprised of ring body means 1 having a central opening 2 with an outer perimeter 3. Three wings 4 extend radially outward from the outer perimeter of the ring body. The roots of the wings are smoothly blended into the perimeter of the ring body. The planform of this preferred embodiment is also shown in FIG. 2.

A key aspect of the present invention is the relative amount of planform area proportioned between the central opening and the wings. The present inventor has discovered that exciting long range flight patterns are achieved when the area of the central opening exceeds the total planform area of the wings. (Note that in this configuration the total area of the wings is the sum of the wing area radially outward from the outer perimeter of the ring-shaped body.)

An added benefit of the large central opening is that it facilitates one-handed catches of the boomerang. As previously mentioned this is difficult with prior multi-winged boomerangs but is demanded by the experienced boomeranger. In the preferred embodiment of the present invention, the ratio of central opening area to wing area is 115%.

It is believed that this superior flight pattern is achieved because the air is allowed to flow through the large central opening and develop lift as it strikes the inner perimeter of the ring body.

As an experiment, a test boomerang was constructed according to the configuration of the present invention, except that the inner and outer diameter of the ringbody was reduced in order to lower the ratio of central opening area to wing area to 75%. Care was taken to make this test boomerang similar to the boomerang of the preferred embodiment in all other respects. The weights of both boomerangs were matched withing 0.1%.

In flight tests, the boomerang of the preferred embodiment flew a flight pattern approximately 15% larger in diameter than the flight pattern of the above test boomerang. This is of particular significance considering that this larger flight pattern was achieved with no expense in size, cost or weight.

Figure 3:
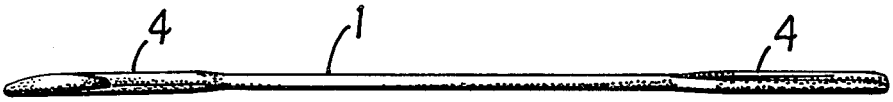
FIG. 3 is an edge view of the invention

FIG. 3 depicts the invention when viewed from its edge. The twist of the wings 4 relative to the ring body 1 is evident in this drawing. Such twist is common to most boomerangs.

Figure 4:
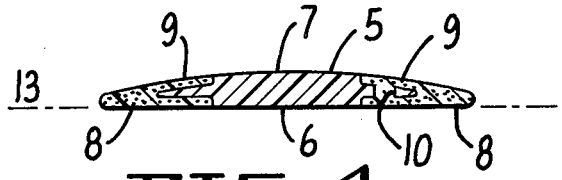
FIG. 4 is a cross section of the ring-body of the invention which shows the preferred cushioned construction and cross-section shape.

FIG. 4 is a cross section of the ring body of the preferred embodiment of the invention and illustrates both the shape of the section but also the method of construction. Note from FIG. 4 that the ring body has a streamlined cross section described by a substantially convex upper line 5 and a substantially straight lower line 6. A streamlined cross-section is defined as a section having a smooth thickness variation from its leading edge to its trailing edge. This cross-section is optimum for boomerangs by reason of its superior range and consistency of flight.

Note also from FIG. 4 that in the preferred embodiment of the invention the ring body is manufactured from two separate materials and by two separate molding steps. Structural support is provided by an inner plastic armature 7. For safety and comfort the armature is covered on its perimeter by a cushion of elastomeric material 8 which is softer than the plastic material of the inner armature.

In the preferred embodiment of the invention the armature is molded in a first mold of high impact thermoplastic with tongue-shaped edges 9. These tongue edges are molded with holes 10. The finished armature is placed in a second mold and thermoplastic elastomer is injected. This elastomer conforms to the edges of the armature tongues and flows through the holes, forming a strong mechanical bond.

While the illustrations depict a boomerang manufactured from a combination a plastic and elastomer, as disclosed above, it is contemplated that for some applications it will be preferred to manufacture the same invention from a single material. This might to desireable to make stiffer product or to reduce manufacturing costs.

Figure 5:
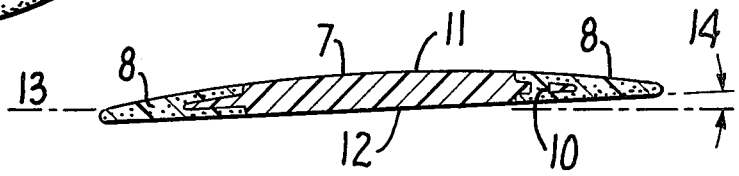
FIG. 5 is a cross-section of one wing of the invention which shows the preferred cushioned construction, cross-section shape and angle of twist.

FIG. 5 is a cross section of one of the wings. In the preferred embodiment of the invention the wings have a steamlined cross section described by a substantially convex upper line 11 and a substantially straight lower line 12. As already described, this section has demonstrated superior flight properties with boomerangs.

FIG. 5 also illustrates how the wings are twisted relative to the plane 13 of the ring, forming an angle of attack 14 such that the wings will produce aerodynamic lift when the boomerang is thrown with a spinning motion in the air.

Finally, FIG. 5 also depicts the method of construction of the preferred embodiment of the invention, in which the wing is supported by an inner plastic armature 7 and surrounded on its perimeter by a cushion of elastomeric material 8.

While the foregoing is believed sufficient disclosure to enable a person skilled in the art to produce an article of the type covered by the appended claims, the detailed dimensions of the preferred embodiment of the invention are given below:

Diameter of central opening=5.4 inches
Outside diameter of ring body=8.1 inches
Length of each wing=3.5 inches Chord of each wing=1.9 inches
Maximum thickness of ring body and wings =0.13 inches
Nominal angle of twist of each wing=3 degrees While in the foregoing specification embodiments of the invention have been set forth in considerable detail for the purpose of making a complete disclosure thereof, it will be apparent to those skilled in the art that numerous changes may be made in such details without departing from the spirit and principle of the invention.

I claim:

1. A boomerang of substantially planar configuration comprising;

a. ring body means comprising a substantially planar ring having a central opening and an outer perimeter, said ring body having a steamlined cross-section described by a substantially convex upper line and a substantially straight lower line, b. three wings, extending radially outward from said outer perimeter of said ring body means, said wings having a streamlined cross-section described by a substantially convex upper line and a substantially straight lower line, said wings twisted relative to the plane of said ring body such that said wings produce aerodynamic lift when the boomerang is thrown with a spinning motion in air, c. said boomerang proportioned such that the planform area of said central opening exceeds the total planform area of said wings.

2. A boomerang as recited in claim 1 which is manufactured of a plastic and/or elastomeric material.

3. A boomerang as recited in claim 1 wherein said ring body and said wings are comprised of an inner plastic armature, said armature surrounded on its perimeter by a cushion of elastomeric material which is softer than the plastic material of said inner armature.

4. A boomerang as recited in claim 1 wherein the ratio of the planform area of said central opening to the planform area of said wings is 115 percent.

5. A boomerang of substantially planar configuration comprising;

a. ring body means comprising a substantially planar ring having a central opening with a diameter of 5.4 inches, an outer perimeter with a diameter of 8.1 inches, and an axial thickness of 0.13 inches, said ring having a streamlined cross-section described by a convex upper line and a substantially straight bottom line, b. three wings, each extending 3.5 inches radially outward from the outer perimeter of said ring body, each wing having; a chord of 1.9 inches, a thickness of 0.13 inches, a streamlined cross-section described by a convex upper line and a substantially straight lower line, and an angle of twist of substantially 3 degrees relative to the plane of said ring body, the roots of said wings being smoothly blended into the outer perimeter of said ring body.

6. A boomerang as recited in claim 5 wherein said ring body and said wings are comprised of an inner plastic armature, said armature being surrounded, on its outer and inner perimeters, by a cusion of elastomermeric material which is softer than the plastic material of said armature.

7. A boomerang as recited in claim 5 monolythically molded from a single thermoplastic material.

* * * * *